US008022319B2

(12) United States Patent
Lament et al.

(10) Patent No.: US 8,022,319 B2
(45) Date of Patent: Sep. 20, 2011

(54) HANDLE OPERATOR LINKAGE WITH SEALING MEANS

(75) Inventors: Tod Taylor Lament, West Liberty, OH (US); Michael J. Holland, Hilliard, OH (US)

(73) Assignee: Siemens Industry, Inc., Alpharetta, GA (US)

( * ) Notice: Subject to any disclaimer, the term of this patent is extended or adjusted under 35 U.S.C. 154(b) by 451 days.

(21) Appl. No.: 12/233,083

(22) Filed: Sep. 18, 2008

(65) Prior Publication Data

US 2009/0078550 A1 Mar. 26, 2009

Related U.S. Application Data

(60) Provisional application No. 60/974,177, filed on Sep. 21, 2007.

(51) Int. Cl.
*H01H 9/20* (2006.01)

(52) U.S. Cl. ..... 200/50.33; 200/339

(58) Field of Classification Search ..... 200/339, 200/561, 43.14, 43.22
See application file for complete search history.

(56) References Cited

U.S. PATENT DOCUMENTS

| | | | | |
|---|---|---|---|---|
| 4,110,585 | A * | 8/1978 | Brown | 200/305 |
| 4,272,662 | A * | 6/1981 | Simpson | 200/275 |
| 4,320,271 | A * | 3/1982 | Munroe | 200/277.2 |
| 5,914,460 | A * | 6/1999 | Mowery et al. | 174/50 |
| 6,541,719 | B1 * | 4/2003 | Powell | 200/50.32 |
| 6,710,273 | B1 * | 3/2004 | Skarlupka et al. | 200/302.3 |
| 7,355,132 | B1 * | 4/2008 | Rezac et al. | 200/43.14 |

* cited by examiner

*Primary Examiner* — Elvin G Enad
*Assistant Examiner* — Lisa Klaus

(57) ABSTRACT

The present invention relates generally to linkage means. More particularly, the invention encompasses a handle operator linkage with sealing means. The present invention is also directed to a novel linkage for controlling switches or breakers, and more particularly to a linkage for use as a double throw switch for controlling two switches or breakers mounted in the same enclosure so that only one switch can be ON at any given time, and the second switch would automatically be in an OFF state.

21 Claims, 6 Drawing Sheets

HANDLE OPERATOR LINKAGE WITH SEALING MEANS

CROSS-REFERENCE TO RELATED APPLICATION

The instant patent application is related to U.S. Provisional Patent Application Ser. No. 60/974,177, filed on Sep. 21, 2007, titled "Handle Operator Linkage With Sealing Means," the entire disclosure of which is incorporated herein by reference.

FIELD OF THE INVENTION

The present invention relates generally to linkage means. More particularly, the invention encompasses a handle operator linkage with sealing means. The present invention is also directed to a novel linkage for controlling switches or breakers, and more particularly to a linkage for use as a double throw switch for controlling two switches or breakers mounted in the same enclosure so that only one switch can be ON at any given time, and the second switch would automatically be in an OFF state.

BACKGROUND INFORMATION

Switching apparatus generally referred to as a double throw switch or standby power panel are commonly used to alternatively connect one of two load devices to a source of electric power or to connect a single load device alternatively to one of two separate sources of electric power. For example, two lines coming into a switch tied to one load coming out of the switch as in a system that has an emergency power generator to switch from normal power source to the emergency generator. Another example is one line coming into a switch tied to two loads coming out of the switch as in a system that has a backup pump that needs to operate when the main pump is offline. The two switch mechanisms are tied together with a linkage. The linkage allows only one switch to be turned ON at a time. Prior linkages typically are assembled using multiple slots in a plate which is secured to a framework by multiple fasteners or rivets which slide in the plurality of slots. Currently, Siemens and other providers of such switching apparatus employ double throw switches for such applications.

U.S. Pat. No. 6,815,623 (Michael J. Holland), the entire disclosure of which is incorporated herein by reference, discloses a double throw switch linkage for coupling two switch apparatuses together in an enclosure. Each switch apparatus is coupled to the switch mechanism having a switch mechanism lever arm. When the lever arm is moved it translates a force to the actuator plate which closes one switch mechanism and maintains the other switch mechanism in an open position.

U.S. Pat. No. 6,872,900 (Tod T. Lament, et al.), the entire disclosure of which is incorporated herein by reference, discloses a double throw switch linkage for coupling two switch apparatuses together in an enclosure. Each switch apparatus is coupled to the switch mechanism having a switch mechanism lever arm. When the lever arm is moved it translates a force to the actuator plate which closes one switch mechanism and maintains the other switch mechanism in an open position.

Also in the market place, for example, there is a need for an auxiliary power source when the main power source is no longer available. In order to connect to the auxiliary power source a switching mechanism must be employed, for example, to disengage main power source and engage the auxiliary power source. To connect back to the main power source the sequence must be reversed; however, both the main power source and auxiliary power source must not be engaged at the same time. This problem has been solved by the inventive handle operator linkage of this invention which engages the main power source while keeping the auxiliary power source disengaged, and then engages the auxiliary power source while keeping the main power source disengaged.

Additionally, there is also a need for a double throw switch linkage that requires fewer parts for assembly thereby reducing costs and complexity.

This invention overcomes the problems of the prior art and provides an inventive handle operator linkage that also has sealing means.

PURPOSES AND SUMMARY OF THE INVENTION

The invention is a novel handle operator linkage with sealing means.

Therefore, one purpose of this invention is to provide a novel handle operator linkage.

Another purpose of this invention is to provide a handle operator linkage with sealing means.

Yet another purpose of this invention is to provide a handle operator linkage with sealing means that can be securely locked in place.

Therefore, in one aspect this invention comprises a handle operator linkage for a double throw switching apparatus, comprising, a handle operator linkage, wherein said handle operator linkage has a lever arm, wherein said lever arm is connected to a mid-section, and wherein a stem section connects a base to said mid-section, said mid-section has a pivot hole and at least one first bump facing said base section, said base section having a back bump, and wherein said back bump faces said at least one first bump, and thereby forming said handle operator linkage for a double throw switching apparatus.

In another aspect this invention comprises a double switch apparatus, comprising:

(a) an enclosure, wherein said enclosure has a right side panel, a left side panel, a top panel, a bottom panel, a base panel, and a cover;

(b) a support panel secured to said enclosure;

(c) at least one circuit breaker assembly secured to said support panel;

(d) at least one handle operator linkage secured to said at least one circuit breaker assembly, such that a lever portion of said handle operator linkage extends out of said enclosure while a base section and a mid-section of said handle operator linkage is pivotally engaged with said at least one circuit breaker assembly.

BRIEF DESCRIPTION OF THE DRAWINGS

The features of the invention that are novel and the elements characteristic of the invention are set forth with particularity in the appended claims. The drawings are for illustration purposes only and are not drawn to scale. Furthermore, like numbers represent like features in the drawings. The invention itself, both as to organization and method of operation, may best be understood by reference to the detailed description which follows taken in conjunction with the accompanying drawings in which:

DETAILED DESCRIPTION

Most double throw switches are actuated by means of a complicated interlocking mechanisms. The interlocking mechanism generally consists of housings, slider plates, lever arms, and handles. However, with this invention the design of a double throw switch has been significantly simplified. Basically, the new inventive design comprises a mounting plate, a pivot pin, and a handle linkage.

The handle operator linkage for coupling 2 circuit breakers or molded case switches apparatuses together are enclosed in an enclosure. The handle operator linkage is a one piece design and basically engages the breakers by a pivot action. The shape of the linkage allows one breaker to be energized while the other breaker is in the OFF position. The handle linkage provides for an interlock feature that only allows one of the breakers to be energized at any given time.

It should be appreciated that the innovative handle operator of this invention in addition to operating 2 circuit breakers the handle operator linkage could be embodied to operate one circuit breaker.

Also the handle operator linkage incorporates a sealing means for construction of a rainproof enclosure.

Figure 1:
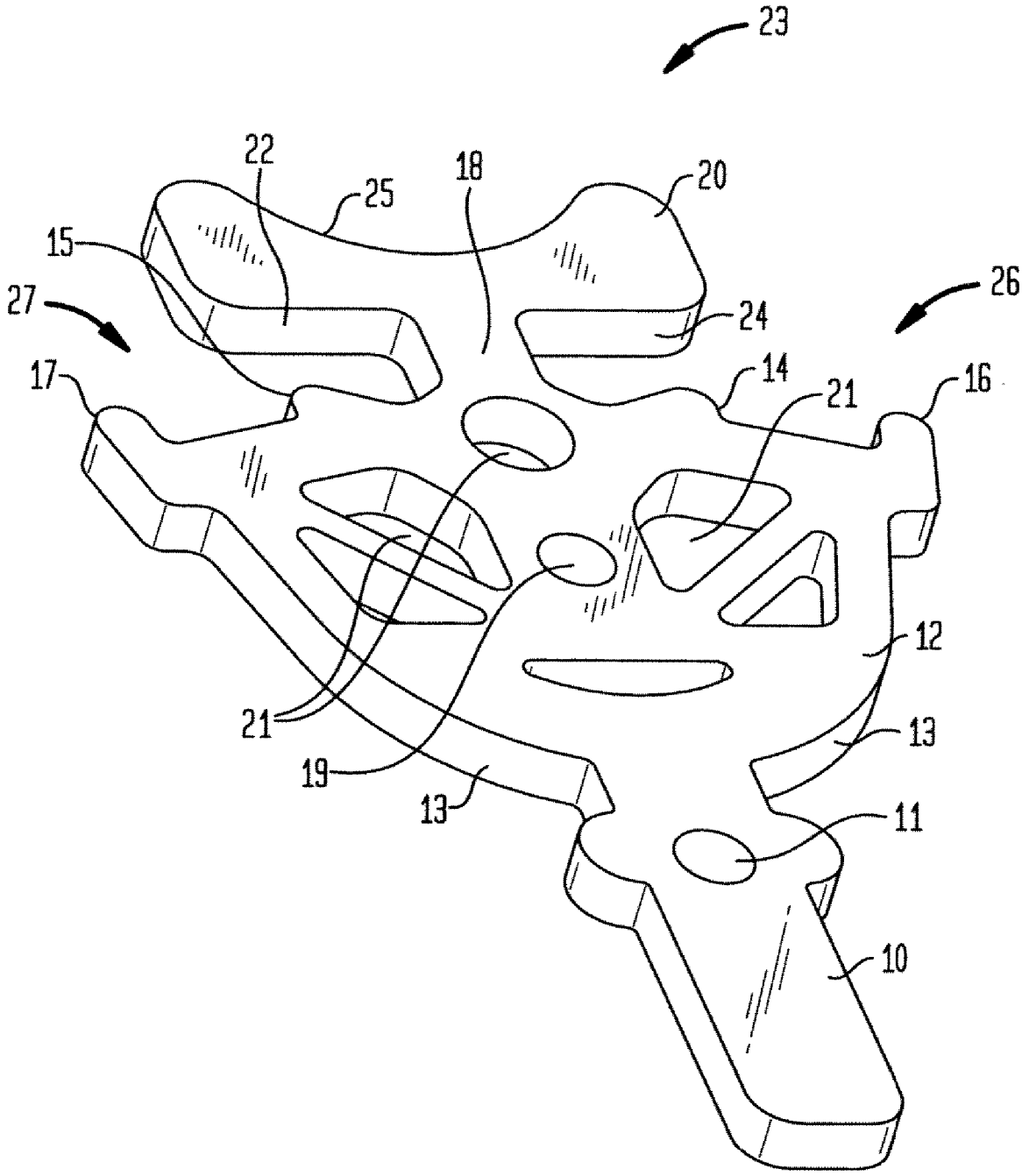
FIG. 1 is an enlarged perspective view of the inventive handle operator linkage with sealing means illustrating an embodiment of the present invention.

FIG. 1 is an enlarged perspective view of the inventive handle operator linkage 23, with sealing means 13, illustrating an embodiment of the present invention. The handle operator linkage 23, comprises of a handle linkage or lever arm 10, a mid-section 12, a stem 18, and a base section 20. The lever arm 10, optionally can have at least one hole or opening 11, for the purposes of securely locking the lever arm 10, such as by a padlock (not shown) to prevent any accidental movement of the lever arm 10, by locking it in the OFF position. The mid-section 12, preferably has a shape so as to provide a sealing means 13, such as, a sealing surface 13, or a sealing edge 13. The mid-section 12, also has a pivot hole or opening 19, and one or more optional access hole or opening 21. The optional access hole 21, allows access to components that may be below the inventive handle operator linkage 23, after the linkage 23, has been installed. The mid-section 12, also has at least one first bump or tab or notch 14, 15, and at least one second bump or tab or notch 16, 17. The stem 18, has a first switching area 26, and a second switching area 27. The base section 20, has a back bump or surface 22, 24, and a terminating surface or edge 25. The first bump 14, 15, which is actually a breaker or switch actuating surface 14, 15, allows for either the turning OFF or turning ON of the circuit breaker associated with the first bump 14, 15, but if one circuit breaker is ON the other or second circuit breaker will be OFF. The second bump 16, 17, which is also a breaker or switch actuating surface 16, 17, allows for either the turning OFF or turning ON of the circuit breaker and is there to provide extra assurance and to prevent any slippage of the circuit breaker from either the ON position or the OFF position. The shape of the switch actuating surface 16 and 17, is such that it prevents an operator from manually turning ON the second breaker when the first breaker is energized. For such situations the door or cover 35, shown in FIG. 6A, would have to be opened for this to occur. The back bump or surface 22, 24, is also a breaker or switch actuating surface 22, 24, and it allows for either the turning OFF or turning ON of the circuit breaker. As one can clearly see in FIG. 1, that the first switching area 26, comprises the first bump 14, the second bump 16, and the back bump 24, while the second switching area 27, comprises the first bump 15, the second bump 17, and the back bump 22.

Figure 2:
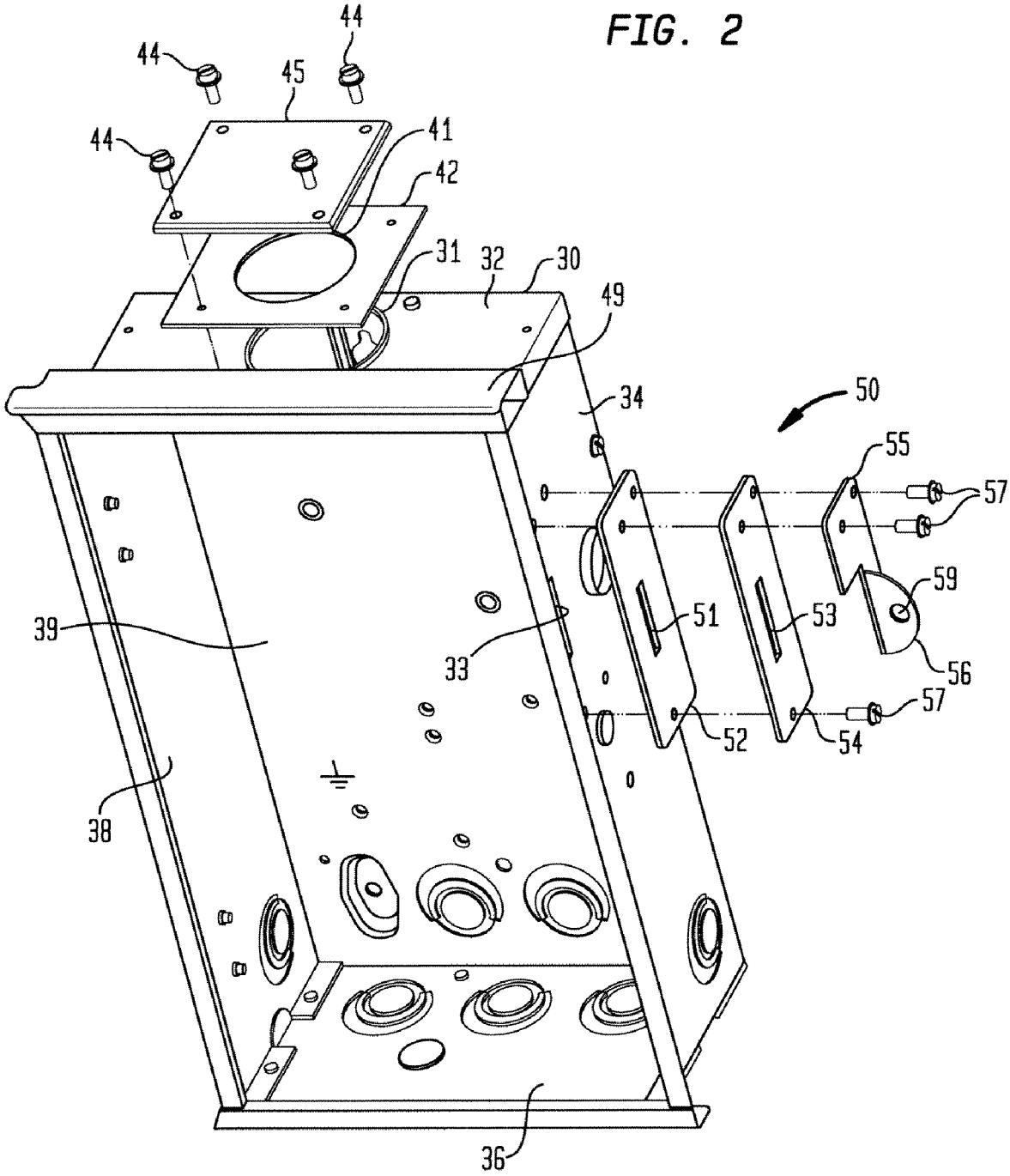
FIG. 2 is an enlarged detailed view showing some of the salient features of the inventive enclosure which is used with the inventive handle operator linkage with sealing means illustrated in FIG. 1.

FIG. 2 is an enlarged detailed view showing some of the salient features of the inventive enclosure 30, which is used with the inventive handle operator linkage 23, with sealing means 13, illustrated in FIG. 1. The circuit breaker enclosure box 30, comprises of a top or upper panel 32, a right side panel 34, a bottom panel 36, a left side panel 38, and a base support or panel 39. The enclosure box 30, has at least one slot or opening 33, for the passage of the handle operator linkage 23. In order to make the enclosure box 30, rain proof a handle operator linkage sealing assembly 50, is preferably provided. The assembly 50, comprises of at least one weather gasket 52, at least one gasket cover 54, and a linkage support 55. The weather gasket 52, has a slot or opening 51, and the gasket cover 54, has a slot or opening 53. The linkage support 55, comprises of a handle support and lock bracket 56. The handle operator linkage assembly 50, is secured to the enclosure box 30, by securing means 57, such as, screws 57. During assembly care should be taken that the hole or slot 51, and hole or slot 53, congruently align with the slot or opening 33, and that handle lock bracket 56, is parallel and adjacent to the hole or slot 53, without blocking the hole or slot 53. The handle support and lock bracket 56, optionally can have at least one hole or opening 59, for the purposes of securely locking the lever arm 10, such as by a padlock (not shown) to prevent any accidental movement of the lever arm 10. In most applications a padlock would be used to lock the handle 10, when the handle 10, is in an OFF position. This locking would be achieved by having locking mechanism pass through both hole 11, in the lever arm 10, and the hole 59, in the handle support and lock bracket 56.

For some applications the enclosure box 30, could have a hole or opening 31, for support components, such as, wiring or wiring harnesses (not shown). The hole or opening 31, could be environmentally closed when not needed by placing a weather gasket 42, and a panel 45, and securing them with securing means 44, to the upper panel 32. The weather gasket 42, may or may not have a hole or opening 41. The securing means 44, could be screws 44. It is preferred that the panel 45, be a rain shield panel 45.

For some applications an optional canopy 49, may be provided. The canopy 49, is preferably secured to the upper panel 32, of the enclosure box 30.

Figure 3:
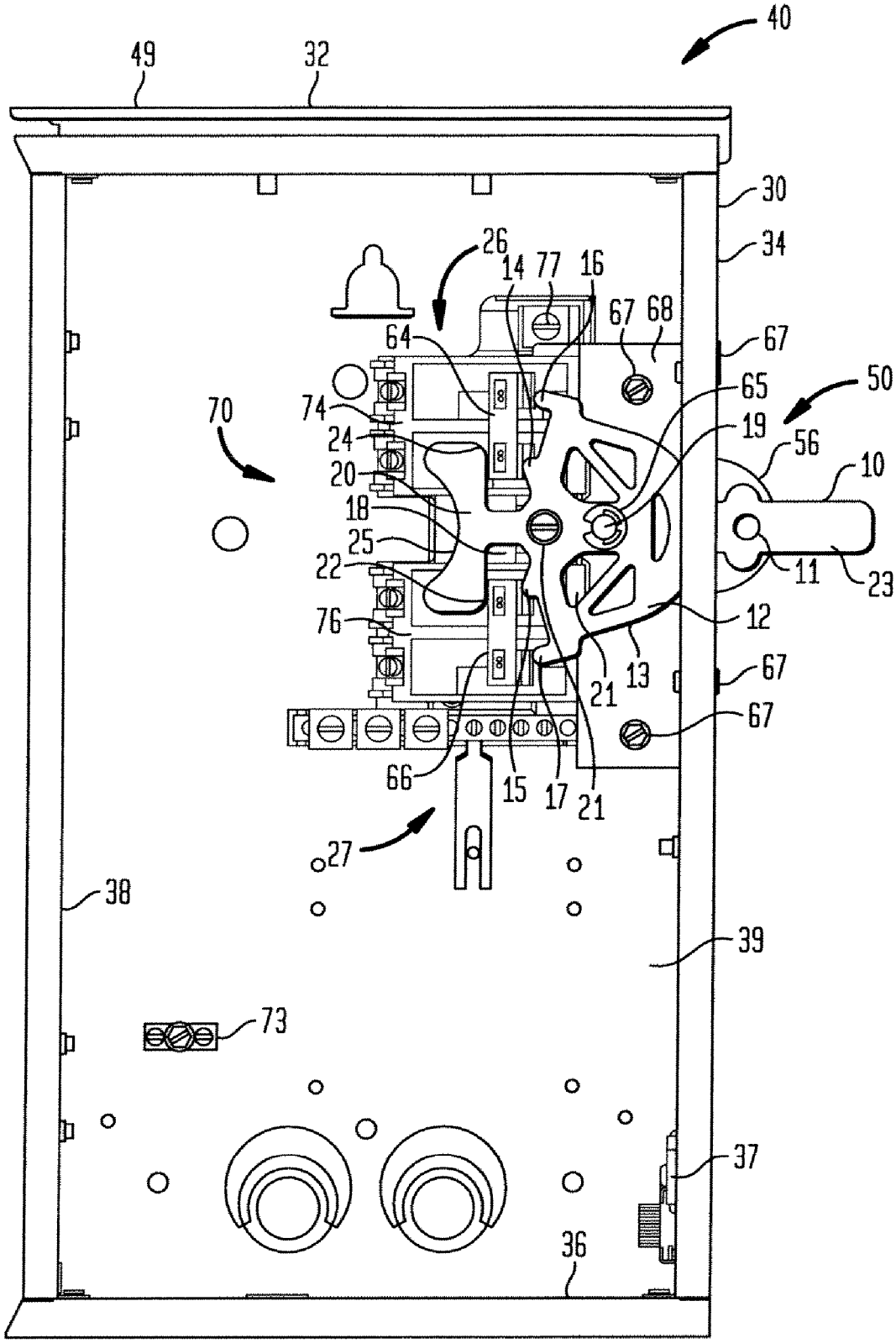
FIG. 3 is a front view of the inventive enclosure with the inventive handle operator linkage with sealing means illustrated in FIG. 1 in the neutral or off position.

FIG. 3 is a front view of the inventive enclosure box 40, with the inventive handle operator linkage 23, with sealing means 13, illustrated in FIG. 1 in a neutral position. At least one circuit breaker assembly 70, is secured to the enclosure box 40, by means of at least one securing means. The enclosure box 40, has one or more lugs 77, for the incoming line or load wires. The breakers 74, 76, could be mounted using screws, din rail or other means. For most applications the breakers 74, 76, snap into a plastic base which is secured by securing means, such as, screws (not shown), but the breakers 74, 76, could be din rail mounted. The circuit breaker or switch assembly 70, comprising a first circuit breaker or switch assembly 74, comprising a first switch or toggle 64, and a second circuit breaker or switch assembly 76, comprising a second switch or toggle 66. The enclosure box 40, preferably has at least one ground connection 73, and at least one enclosure cover or door securing means 37.

As one can see in FIG. 3, the handle operator linkage 23, has been inserted into the circuit breaker box 30, from the left side, such that the stem 18, is substantially in line with the first toggle breaker 64, between the first bump 14, and the first back surface 24, in the first switching area 26, and similarly, the second toggle breaker 66, is between first bump 15, and the second back surface 22, in the second switching area 27. A securing means 65, passes through the pivot hole 19, and pivotally secures the operator linkage 23, to a support panel 68, of the circuit breaker assembly 70. The panel 68, is secured to the enclosure box 30, by means of securing means 67, such as, screws or bolts 67. The panel 68, may also have a side bracket which can further securely mount the panel 68, from the side, using securing means 67, as more clearly seen in FIG. 6B. The panel 68, could be a U-shaped bracket 68, such that one side of the U-shaped bracket 68, mounts on the side panel 34, and that a side portion of the U-shaped bracket 68, has a hole or opening or slit for the passage and pivotal movement of the lever arm 10.

It is preferred that the first contact surface 14 and the back bump 24, are in physical contact or in close proximity to the first toggle switch 64, and the first contact surface 15 and the back bump 22, are in physical contact or in close proximity to the second toggle switch 66.

Figure 4:
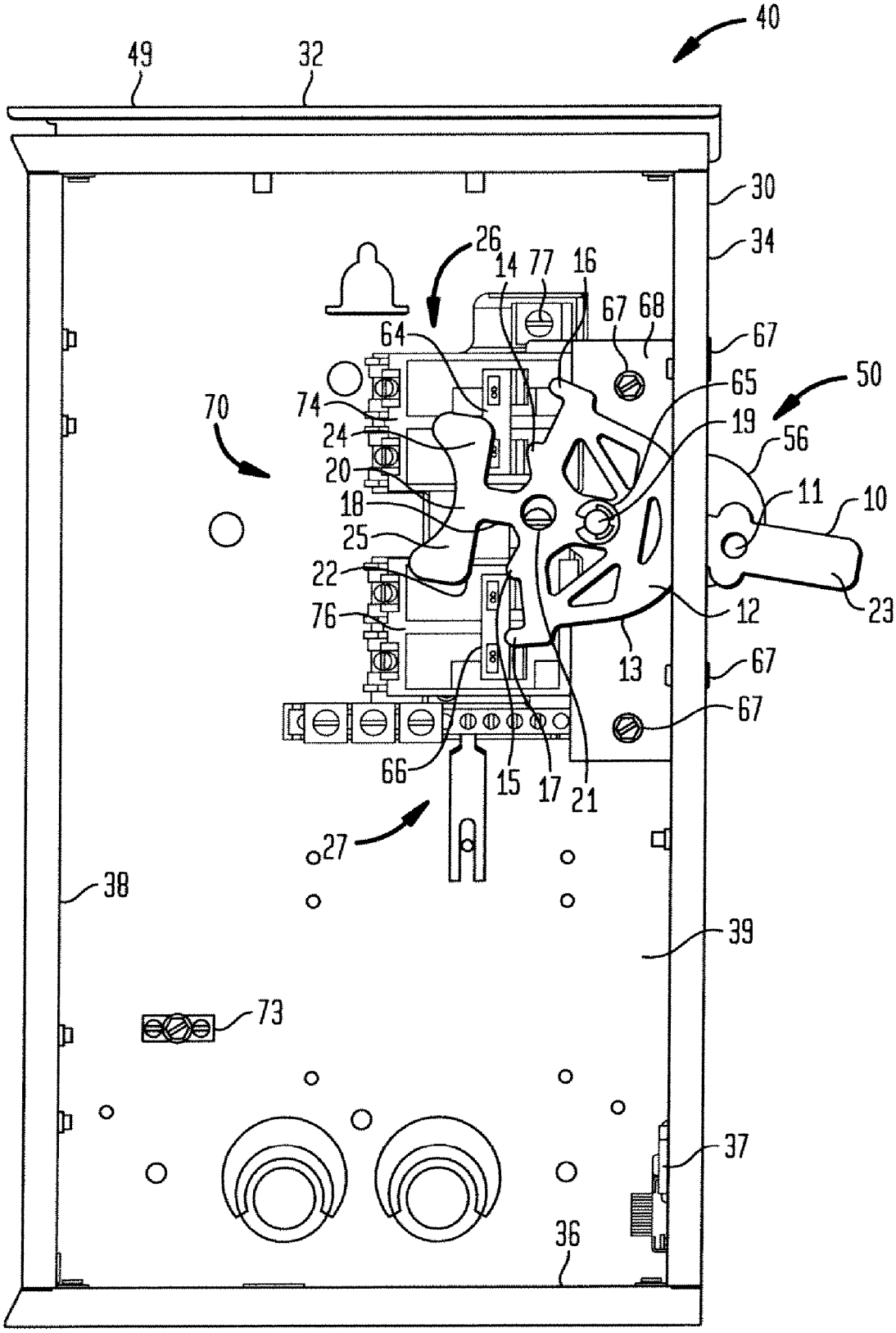
FIG. 4 is a front view of the inventive enclosure with the inventive handle operator linkage with sealing means illustrated in FIG. 1 with a first circuit breaker or switch in an ON position.

FIG. 4 is a front view of the inventive enclosure box 40, with the inventive handle operator linkage 23, with sealing means 13, illustrated in FIG. 1 with a first circuit breaker or switch 74, in an ON position, such that the first toggle switch 64 has been moved from the OFF position to the ON position by the force from the back bump 24, while the second circuit breaker 76, is in an OFF position as the second toggle switch 66, has been moved to the OFF position by the force from the first bump 15. It should be appreciated that the second bump 17, also prevents an operator from turning toggle switch 66 to the ON position.

Figure 5:
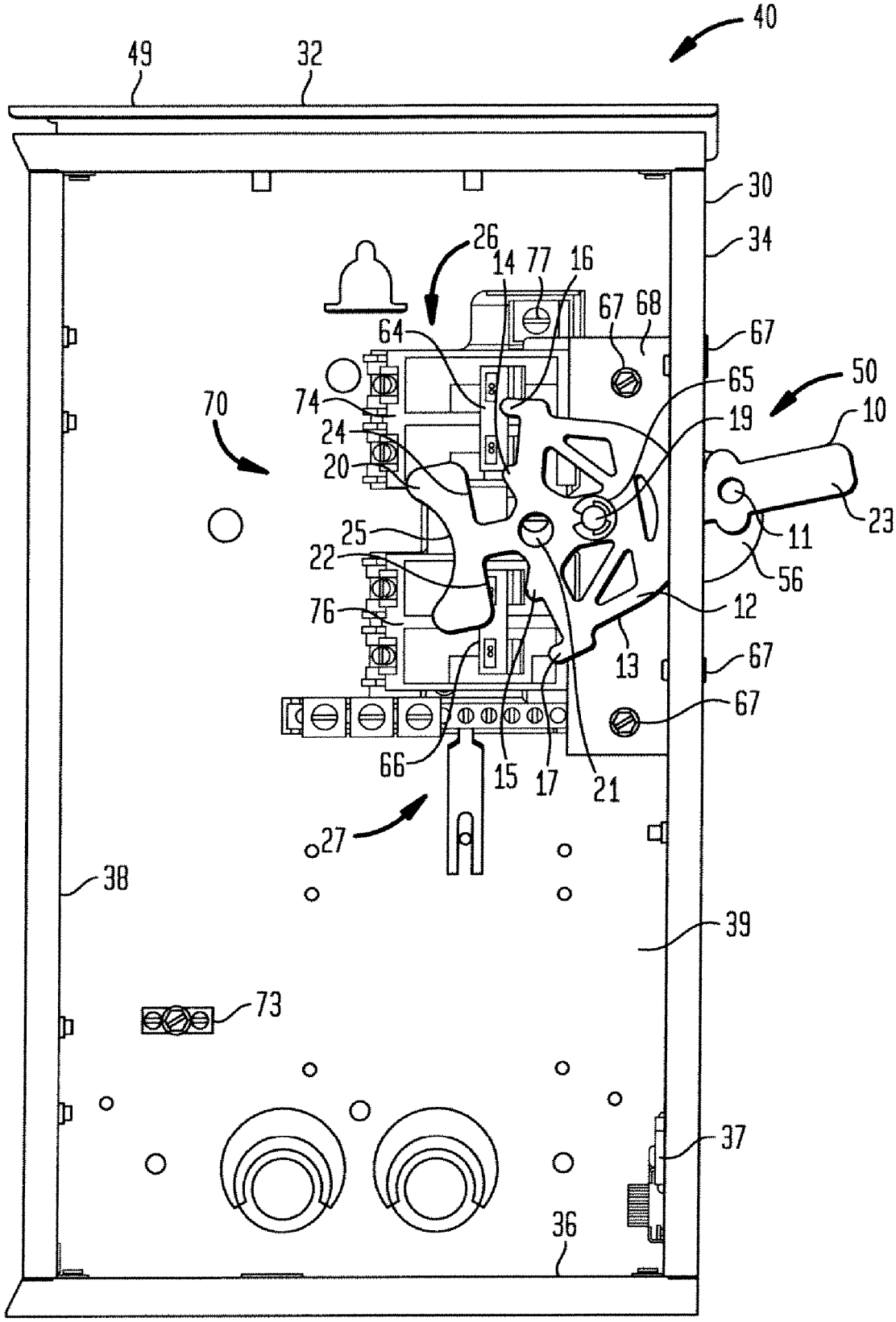
FIG. 5 is a front view of the inventive enclosure with the inventive handle operator linkage with sealing means illustrated in FIG. 1 with a second circuit breaker or switch in an ON position.

FIG. 5 is a front view of the inventive enclosure 40, with the inventive handle operator linkage 23, with sealing means 13, illustrated in FIG. 1 with a second circuit breaker 76, in an ON position, as the second toggle switch 66, has been moved from the OFF position to the ON position by the force from the back bump 22, while the first toggle switch 64, has been moved to the OFF position by the force from the first bump 14. Again, it should be appreciated that the second bump 16, prevents an operator from turning the toggle switch 64, to the ON position.

Figure 6A:
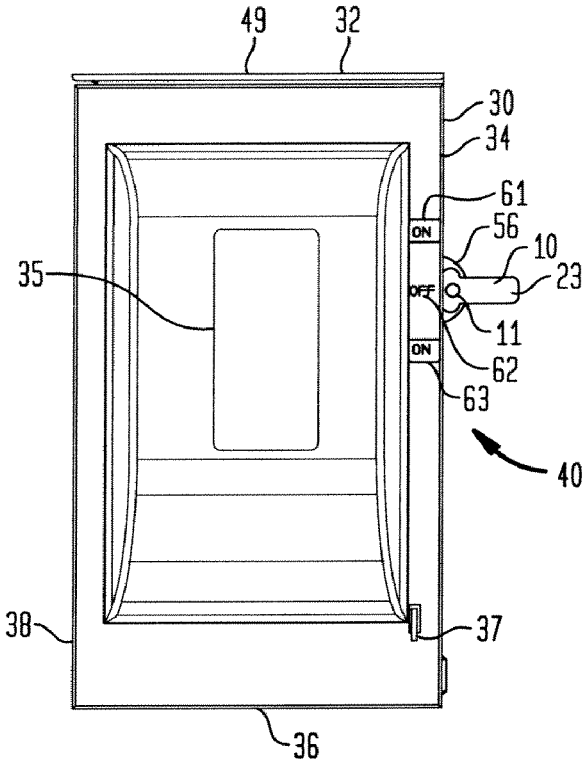
FIG. 6A is a front view of a completely assembled inventive enclosure with the inventive handle operator linkage with sealing means illustrated in FIG. 1 in a neutral or off position.

FIG. 6A is a front view of a completely assembled inventive enclosure 40, with the inventive handle operator linkage 23, with sealing means 13, illustrated in FIG. 1 in a neutral or OFF position, and where a door or cover 35, provides environmental protection to the contents of the enclosure box 30. At least one enclosure cover or door securing means 37, such as, locking bracket 37, may optionally be provided to securely lock the contents of the enclosure box 40. One section of the optional locking bracket 37, is secured to a portion of the enclosure box 30, such as the side panel 34. The locking bracket 37, secures the cover 35. The cover 35, could have optional markings 61, 62, 63, where for example, marking 61, could be for "Main ON" or "Auxiliary ON", while marking 62, could be for "Neutral" or "OFF", while marking 63, could be for "Main ON" or "Auxiliary ON." However, if one marking is for "Main ON" then the second marking on the door 35, has to be for "Auxiliary ON." Additionally, these markings 61, 62, and 63, would correspond to the up or down position of the lever 23, which in turn would correspond to the OFF position of the first switch 64, and the ON position of the second switch 66, or vice versa, or the neutral or OFF position 62, for both.

Figure 6B:
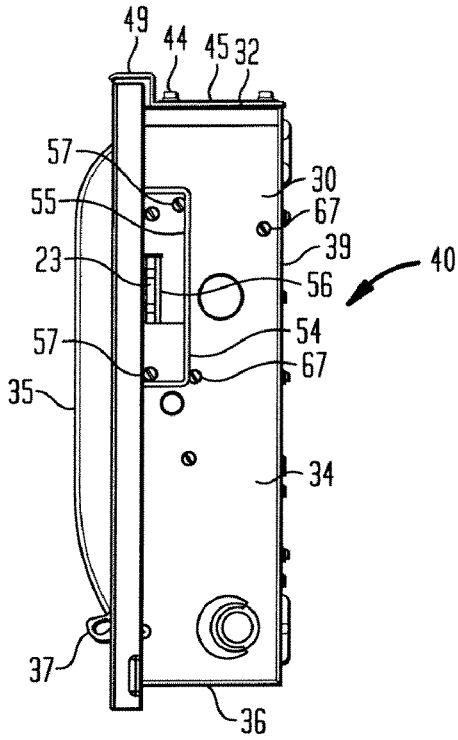
FIG. 6B is a right side view of a completely assembled inventive enclosure illustrated in FIG. 6A.

FIG. 6B is a right side view of a completely assembled inventive enclosure 40, illustrated in FIG. 6A, showing the one end of the optional locking bracket 37, passing through the door 35, while the opposite end is secured to the side wall 34.

Figure 6C:
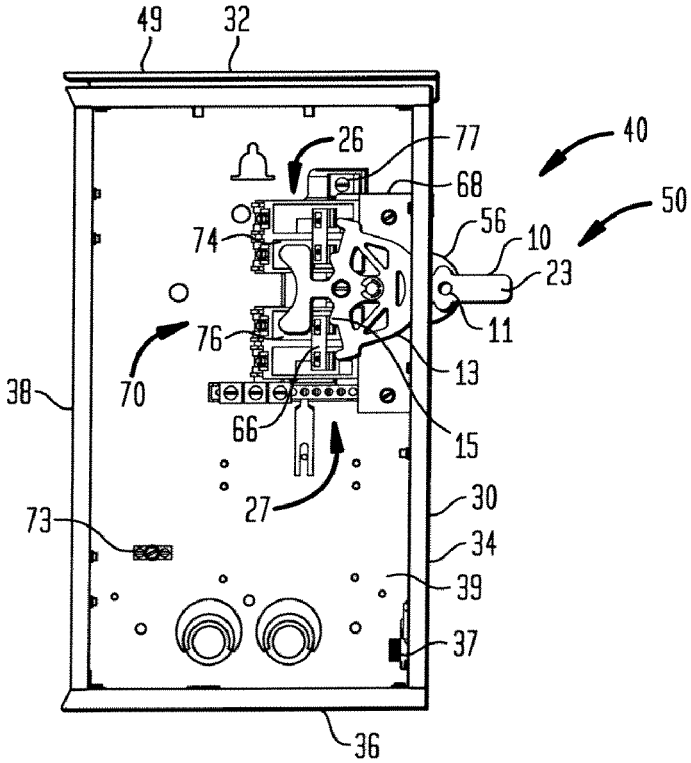
FIG. 6C is a front view of a completely assembled inventive enclosure illustrated in FIG. 6A with the cover removed.

FIG. 6C is a front view of a completely assembled inventive enclosure 40, illustrated in FIG. 6A with the cover 35, removed.

Referring now to FIG. 3, which illustrates an exemplary embodiment of the double throw switch linkage 23, which is mounted in the enclosure box 30, and is securely coupled to the two switches or breakers 74 and 76. Each switch or breaker 74, 76, is coupled to a switching apparatus 70. The switching apparatus 70, typically are configured for multiple phase connections and can be rated from about 30 amps to about 200 amps. The enclosures box 30, is typically a North American Electrical Manufacturers Association (NEMA) Type 1, 3R. It is contemplated, that other current rating and enclosure configurations can be suitable for the double throw switch linkage 23, disclosed herein.

The double throw switch assembly 70, is actually two switch or breaker apparatus 74, and 76, that are combined in a single enclosure box 30. The switching mechanism 70, is coupled together with a double throw switch linkage 23. The double throw switch linkage 23, allows only one switch to be turned ON at any given time, while the other switch is automatically turned OFF.

A typical operating sequence for the double throw switch mechanism 70, provides that the lever arm 23, of the lever arm assembly 50, is positioned in an OFF position. Which is the mid-point position both switch apparatus 70 are neutral or OFF. If an operator, for example, moves the lever arm 23, in one direction one of the switch apparatus 74, 76, will be closed and energized and the other switch apparatus 74, 76, would be in an OFF state. The lever arm 23, is typically at the upper limit of the handle throw, for example in FIG. 3, the lever arm 23, would be moved in the direction towards the top, as shown in FIG. 5. As the operator moves the lever arm 23, back to the mid or OFF position, the first switch would be in the open or OFF position. When the operator would move the handle or lever 23, to a second position the second switch apparatus 74, 76, would be closed or energized or in an ON state, and the first switch apparatus 74, 76 would still be in the OFF position. By moving the lever arm 23, back to the mid point position, the second switch apparatus 74, 76, would be returned to the neutral or OFF position.

This invention provides a water-resistance sealing surfaces for the handle operator linkage assembly 50, with the combination of the gasket cover 52, or weather gasket 52, with the sealing means 13, so that now the entire assembly 40, is water resistant. This is achieved by the use of sealing means 13, that has a surface with a radius, and weather gasket 52, and the gasket cover 54, have limited access for moisture to pass through the slits, 53, 51, 33.

It should be appreciated that the bumped surface 14, 15, 16, 17, 22, and 24, do not allow both breakers or switches 74, 76, to be turned ON at the same time. It is the surface of these bumps that interlocks with the breakers 74, 76, together as without these bumped surfaces both breakers 74, 76, could be in the ON position.

The handle operator linkage 23, is preferably made of an electrically nonconductive material, wherein the electrically nonconductive material is selected from a group comprising, plastic, rubber, composite material, and combination thereof, to name a few.

The hole or opening 11, in the handle operator linkage 23, is preferably selected from a group comprising, a trapezoidal hole, a square hole, a rectangular hole, a circular hole, an elliptical hole, a triangular hole, and combination thereof, to name a few.

While the present invention has been particularly described in conjunction with a specific preferred embodiment, it is evident that many alternatives, modifications and variations will be apparent to those skilled in the art in light of the foregoing description. It is therefore contemplated that the appended claims will embrace any such alternatives, modifications and variations as falling within the true scope and spirit of the present invention.

What is claimed is:

1. A handle operator linkage adapted for use with a double throw switching apparatus, comprising:

a base section having a back bump, a midsection having a pivot hole and at least one first bump facing said base section, said back bump faces said at least one first bump at a first switching area adapted to receive a toggle of a breaker or switch apparatus, a stem connecting said base section to said mid-section, and a lever arm connected to said mid-section, thereby forming said handle operator linkage for a double throw switching apparatus adapted to couple to two switch or breaker apparatus.

2. The handle operator linkage of claim 1, wherein mid-section has at least one second bump facing said base section.

3. The handle operator linkage of claim 1, wherein a peripheral surface edge of said mid-section is wider at a location distal said lever arm than a peripheral surface edge of said mid-section adjacent to said lever arm.

4. The handle operator linkage of claim 1, wherein said handle operator linkage is made of an electrically nonconductive material, and wherein said electrically nonconductive material is selected from a group consisting of plastic, rubber, composite material, and combination thereof.

5. The handle operator linkage of claim 1, wherein said pivot hole in said handle operator linkage is selected from a group consisting of a trapezoidal hole, a square hole, a rectangular hole, a circular hole, an elliptical hole, a triangular hole, and combination thereof.

6. The handle operator linkage of claim 1, wherein said handle operator linkage has at least one access hole.

7. The handle operator linkage of claim 1, wherein said back bump has a substantially flat surface.

8. The handle operator linkage of claim 1, wherein said lever arm has at least one hole.

9. The handle operator linkage of claim 1, wherein said lever arm has at least one hole, and wherein said hole is selected from a group consisting of a trapezoidal hole, a square hole, a rectangular hole, a circular hole, an elliptical hole, a triangular hole, and combination thereof.

10. A double switch apparatus, comprising:

(a) an enclosure, wherein said enclosure has a right side panel, a left side panel, a top panel, a bottom panel, a base panel, and a cover;

(b) a support panel secured to said enclosure;

(c) at least one circuit breaker assembly secured to said support panel;

(d) at least one handle operator linkage secured to said at least one circuit breaker assembly, such that a lever portion of said handle operator linkage extends out of said enclosure while a base section and a mid-section of said handle operator linkage is pivotally engaged with said at least one circuit breaker assembly having a first breaker and a second breaker, and wherein said handle operator linkage is in pivotal contact with said first breaker and said second breaker.

11. The double switch apparatus of claim 10, wherein said mid-section has at least one first bump, and wherein said at least one first bump is in pivotal contact with said at least one first circuit breaker assembly.

12. The double switch apparatus of claim 10, wherein said base section has at least one back bump, and wherein said at least one back bump is in pivotal contact with said at least one first circuit breaker assembly.

13. The double switch apparatus of claim 10, wherein said mid-section has at least one second bump, and wherein said at least one second bump prevents any slippage of said first breaker or said second breaker.

14. The double switch apparatus of claim 10, wherein said enclosure has at least one handle operator linkage assembly, and wherein said at least one handle operator linkage assembly has at least one opening, and wherein said lever portion of said handle operator linkage extends out of said opening in said handle operator linkage assembly.

15. A double switch apparatus, comprising:

(a) an enclosure, wherein said enclosure has a right side panel, a left side panel, a top panel, a bottom panel, a base panel, and a cover;

(b) a support panel secured to said enclosure;

(c) at least one circuit breaker assembly secured to said support panel;

(d) at least one handle operator linkage secured to said at least one circuit breaker assembly, such that a lever portion of said handle operator linkage extends out of said enclosure while a base section and a mid-section of said handle operator linkage is pivotally engaged with said at least one circuit breaker assembly, wherein movement of said lever arm translates a force to said at least one circuit assembly which moves a first circuit breaker to a first position and moves a second circuit breaker to a second position.

16. The double switch apparatus of claim 15, wherein said first position is selected from a group consisting of an ON position, an OFF position, and a neutral position, and wherein said first position is different than said second position.

17. The double switch apparatus of claim 15, wherein the first position is an ON position and the second position is an OFF position.

18. The double switch apparatus of claim 10, wherein said handle operator linkage assembly has at least one weather gasket, and wherein said weather gasket provides rain protection to said enclosure.

19. The double switch apparatus of claim 10, wherein said lever arm has at least one lever arm opening, and said handle operator linkage assembly has at least one lock bracket, and wherein said lock bracket has at least one opening, and wherein at least one lock mechanism passes through said lever arm opening and said lock bracket opening to prevent any pivotal movement of said lever arm.

20. The double switch apparatus of claim 10, wherein said cover has at least one cover opening, and wherein at least one lock bracket is secured to said cover, such that a portion of said lock bracket having at least one opening extends through said at least one cover opening, and wherein at least one lock mechanism passes through said lock bracket opening to prevent opening of said cover.

21. The double switch apparatus of claim 10, wherein said handle operator linkage is made of an electrically nonconductive material, and wherein said electrically nonconductive material is selected from a group consisting of plastic, rubber, composite material, and combination thereof.

* * * * *